United States Patent [19]

Calini

[11] 4,020,132

[45] Apr. 26, 1977

[54] CONSTRUCTION JOINT FOR REINFORCED CONCRETE STRUCTURES

[76] Inventor: Anthony J. Calini, Rte. No. 1, Guilford, Conn. 06437

[22] Filed: Nov. 26, 1975

[21] Appl. No.: 635,291

Related U.S. Application Data

[63] Continuation of Ser. No. 171,090, Aug. 12, 1971, abandoned.

[52] U.S. Cl. ..... 264/34; 52/378; 52/583; 52/741; 264/35; 403/186

[51] Int. Cl.[2] ..... E04G 21/00

[58] Field of Search ..... 52/741, 127, 378, 583, 52/581; 264/31, 33, 239, 34, 35; 249/9, 30, 33, 85, 84, 96, 97; 425/65; 404/56; 403/186, 252, 353

[56] References Cited

UNITED STATES PATENTS

| | | | |
|---|---|---|---|
| 767,582 | 8/1904 | Lewman | 52/378 |
| 1,843,375 | 2/1932 | Sheahan | 52/486 |
| 2,462,415 | 2/1949 | Nagel | 52/583 |
| 2,920,475 | 1/1960 | Graham | 52/432 |
| 3,300,931 | 1/1967 | Lutze | 52/486 X |

FOREIGN PATENTS OR APPLICATIONS

| | | | |
|---|---|---|---|
| 1,272,509 | 7/1968 | Germany | 52/586 |
| 1,242,836 | 6/1967 | Germany | 52/586 |
| 5,456 | 1899 | United Kingdom | 52/583 |

*Primary Examiner*—Alfred C. Perham
*Attorney, Agent, or Firm*—DeLio and Montgomery

[57] ABSTRACT

This specification relates to apparatus and method for improving construction joints in reinforced concrete structures. A coupling member extends a short distance beyond the joint between two pours and has edges which mechanically couple to joining or adaptor members on the ends of reinforcing bars.

5 Claims, 8 Drawing Figures

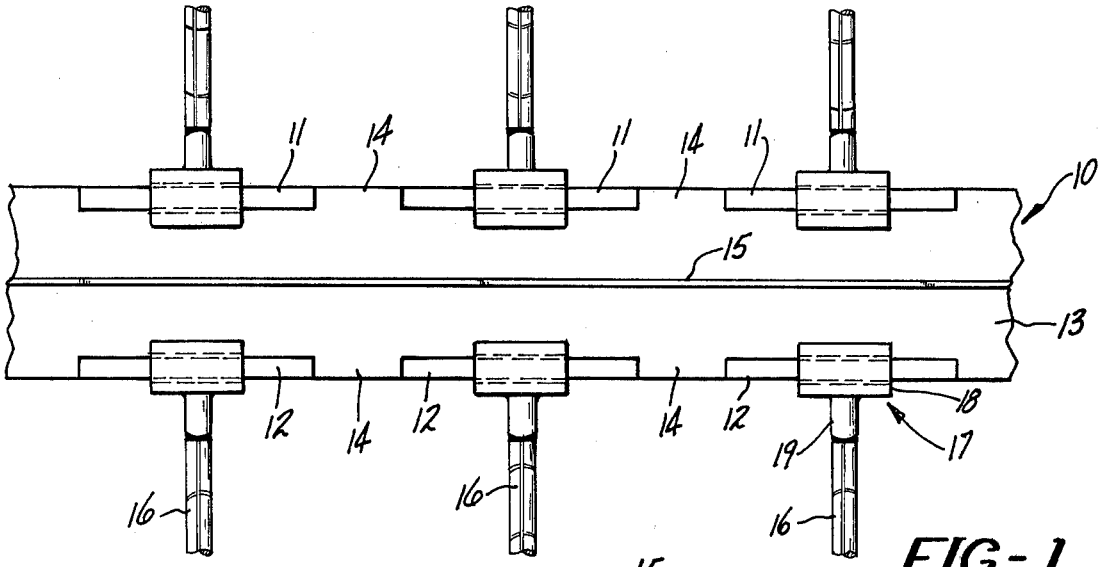
FIG-1
FIG-2A
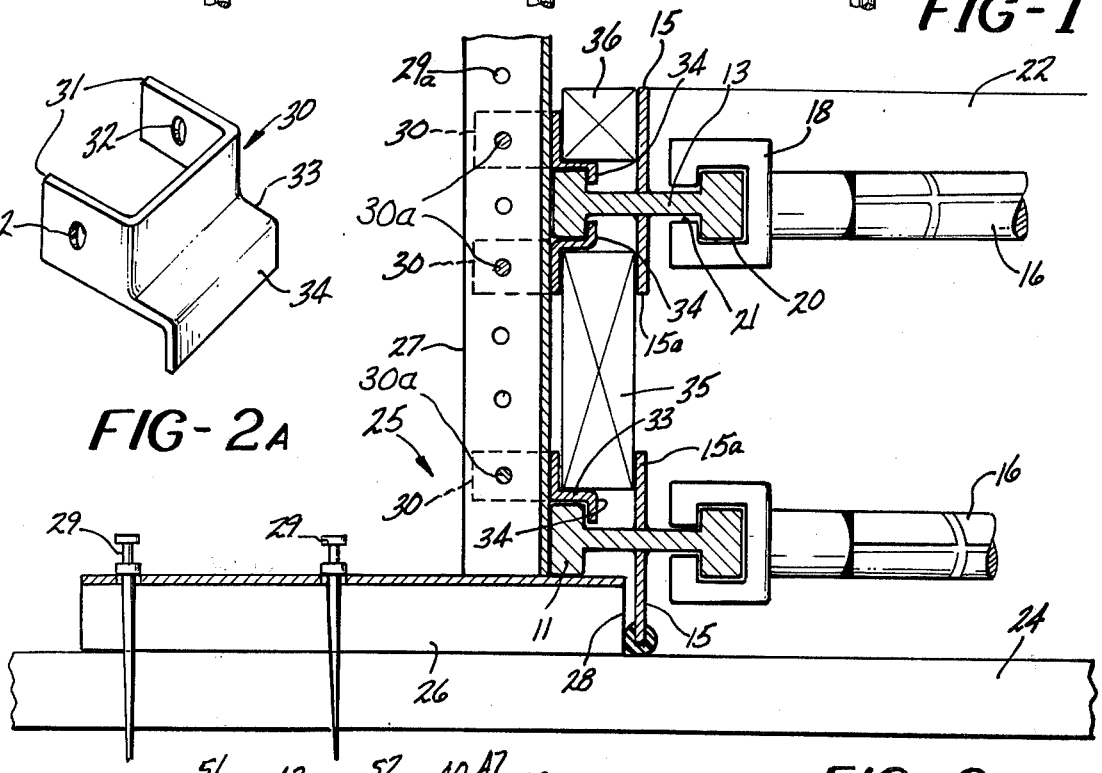
FIG-2
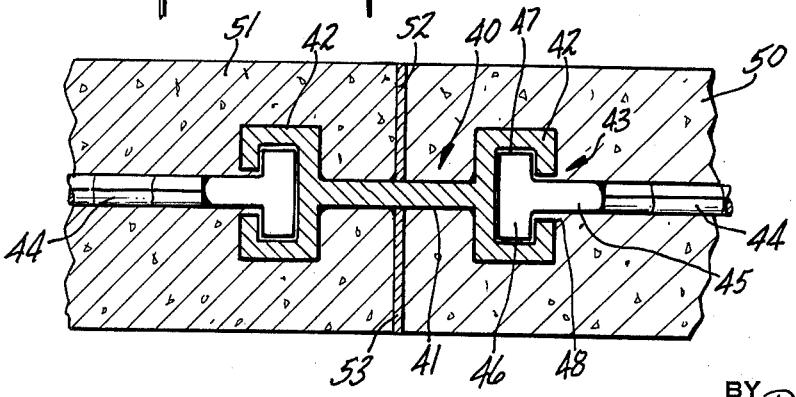
FIG-3
ANTHONY J. CALINI
INVENTOR
BY DeLio and Montgomery
ATTORNEYS

ANTHONY J. CALINI
INVENTOR

BY De Lio and Montgomery
ATTORNEYS

CONSTRUCTION JOINT FOR REINFORCED CONCRETE STRUCTURES

This is a continuation of application Ser. No. 171,090, filed Aug. 12, 1971, now abandoned.

This invention relates to reinforced concrete structures and more particularly relates to a reinforced concrete construction joint and method of making the same.

In making structures of reinforced concrete, the various columns, slabs, decks, platforms, etc. must be made in different pours of concrete which are joined or tied in together. In pouring decks or slabs which are to be joined to supporting walls or columns, or in pouring sections of slabs which are joined or abutted together, it is the practice to extend reinforcing bars from the first pour for bridging the joint into the next pour. This requires that a form or dam be provided at the end of the first pour or at some section thereof with holes or openings therein to pass the end of the bar extensions. After the concrete in the first pour has cured, it is very difficult to remove the form or dam from about the bar extensions and, in most cases, it must be laboriously removed by destruction. Additionally, the constructing of such forms for extensions of reinforcing bars is laborious and time-consuming, all of which adds to the cost of the job.

In view of the deficiencies of the usual practices, the present invention provides a concrete construction joint which permits reinforcing bars to stop at a construction joint and eliminates all drilling and fitting of forms for extending reinforcing bars. The present invention further provides a reinforced concrete construction having greater integrity in tensile than obtained by overlapped reinforcing bars. It further provides the contractor with the opportunity to construct only the form work necessary for a particular pour.

Briefly stated, the invention in one form thereof comprises the use of reinforcing bars having retaining members thereon which are interlocked to a coupling member having a body portion and flange-like edge portions. The flanged edge portions are intermittently cut away or interrupted from the body portion along the length thereof to permit the retaining members to be slipped over the body portion and slide along the length of the flanged edges. The concrete pour may be made to an intermediate portion of the coupling member and reinforcing bars later interlocked to the other flanged edge for a succeeding pour. Alternatively, the coupling member may be constructed with the retaining members along the edge thereof and a flanged head member welded to the end of the reinforcing bar for a reverse type connection to that described above.

An object of this invention is to provide new and improved apparatus and method for making a reinforced concrete construction joint.

Another object of this invention is to provide a new improved apparatus and method for continuing reinforcing members through concrete construction joints which eliminates all drilling and fitting of end forms for extending reinforcing bars.

A still further object of this invention is to provide a new improved apparatus and method for reinforced concrete construction having greater integrity in tensile strength and which also permits the contractor to construct only the form work necessary for one pour without being then concerned about the form work for succeeding pours.

The features of the invention which are believed to be novel are particularly pointed out and distinctly claimed in the concluding portion of this specification. However, the invention both as to its organization, operation, and method of practice together with further objects and advantages thereof may best be appreciated by reference to the following detailed description taken in conjunction with the drawings, wherein:

FIG. 1 is a view of an assembly of a coupling member and reinforcing bars in a horizontal plane as seen from above;

FIG. 2 is a side view of a coupling and forming technique therefore using the invention;

FIG. 3 is a view in vertical section showing a joint between two concrete slabs embodying an alternate construction of the invention;

Figure 4:
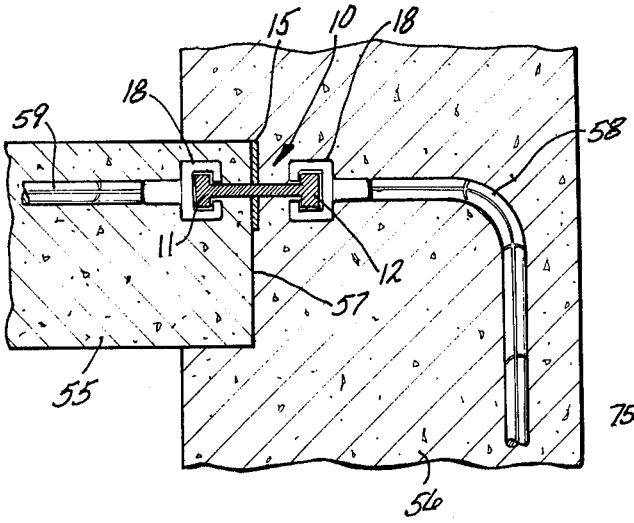
FIG. 4 is a view in elevation exemplifying a technique of joining a horizontal slab to a vertical wall utilizing the invention.

In practicing the invention, a coupling member 10 is provided having flange-like members 11 and 12 along either edge thereof joined to a body or intermediate or web portion 13. Along the length of member 10 the flanges 11 and 12 are interrupted or removed at the areas exemplified by reference numberal 14.

A web-like fin 15 may be provided along the length of coupling member 13 along one or both sides thereof intermediate the edges thereof for purposes hereinafter described. A plurality or reinforcing bars (rebars) 16 have integrally joined to the ends thereof in interlocking or joining member 17. Joining member 17 has a head portion 18 and a shank portion 19. The shanks of members 17 are welded to the end of the rebars 16 as hereinafter described.

Referring to FIG. 2, the head 18 is formed with a slot 20 therethrough which is slightly larger in dimension and of substantially the same shape as the flanges 11 and 12. The head 18 further has an opening 21 therein of slightly larger dimension than the thickness of the body 13 of coupling member 10.

In the construction shown in FIG. 2, upper and lower arrays or rebars are used in a slab 22.

The form for a construction joint as shown in FIG. 2 may comprise a plurality of generally L-shaped members 25 which consist of a bottom base member 26 in the form of a channel and having welded thereto an upright channel member 27 spaced a slight distance from one end 28 thereof. The base members 26 are positioned on the bottom formed sections at predetermined on-center dimensions and secured thereto by a plurality of form nails 29 extending through apertures therein into lower form section 24. The upright channel members 27 have a plurality of apertures **29*a* in the opposite walls thereof adapted to receive a pin (30*a*) for attachment of a retainer clip 30 (FIG. 2*a*). Clip 30** is generally U-shaped with extending spaced apart walls 31 adapted to fit on either side of members 27. The walls 31 have aligned apertures 32 therethrough adapted to receive the pin for attachment to upright members 27. The clips 30 have an outwardly extending flange 33 with a portion 34 thereof extending at substantially right angles thereto.

The fins 15 and 15*a* may be dimensioned to position a coupling member 13 a predetermined distance from the top or bottom of a slab and hence position the rebars a predetermined distance from the surface of the slab. For example, the fin 15 may be dimensioned to position a rebar 1½ inches from the surface and the fin 15*a* dimensioned to position a rebar ¾ of an inch from a surface depending upon building specifications.

In the construction of FIG. 2 the members 25 are aligned a predetermined distance on center. The flange 11 of the lower coupling member 10 is positioned over base member 26 over end portion 28. Lower clips 30 are positioned on upright members 27 with the depending flange portion 34 overlying a portion of flange 11. A damming member 35 which may be in the form of a wooden timber or timbers or a plurality of aligned wood or plastic key strips is positioned between the lower coupling 10 and the fin 15*a* of the lower coupling member. Intermediate clip members 30 are then attached to upright members 27 and the flange 11 of the upper coupling member 10 is positioned across the intermediate clips 30. The upper clips 30 ae then attached to the upright members 27, and the upper spacing or damming member 36 is positioned between upper clip 30 and fin 15 of the upper coupling member 10. This construction now presents a complete dividing line or end wall for concrete slab 22. The upper and lower rebars 16 may now be positioned on the flange 12 of coupling members 10 as previously described. Then the concrete for slab 22 is poured. Upon curing of the concrete spacing member 36 is removed as well as the upper clips 30. The pins may be removed from all of the clips 30 and upright members 27, the forming nail 29 removed and then the members 25 pulled away from the coupling members. Thereafter, the clips 30 may be slid along the flanges 11 and removed at a recess 14. The damming member or members 35 are then removed. At this time, all of the forming members have been easily removed without destruction thereof and the coupling member 10 extends through the concrete joint.

The flanges 11 are then available for attachment to additional rebars that would extend to the left as viewed in FIG. 2 for casting in another pour or slab.

This construction affords the contractor the opportunity to easily erect the form work necessary for a particular form. Moreover, there is a complete mechanical connection across the construction joint which will fully develop tensile strength at the joint.

FIG. 3 exemplifies an alternate form of the invention to that shown in FIGS. 1 and 2. In FIG. 3 a coupling member 40 is utilized having an intermediate body or web portion 41 with retaining members 42 welded thereto along the length thereof. Alternatively, the members 42 may be structurally formed with the body member or web 41. Retaining members 42 receive therein a connection or adaptor member 43 which is welded to the end of rebars 44. The member 43 has a shank portion 45 and a head 46 which has a cross-sectional configuration similar to a cavity or slot 47 defined in members 42. The opening 48 into the retaining member 42 is substantially the same dimension as the shanks 45. As shown, coupling member 40 mechanically connects rebars 44 between slabs 50 and 51 in the same manner as previously exemplified.

The coupling member 40 may also utilize fins 52 and 53 as previously described. The joining members 42 are also interrupted along the length of retaining members 42 thereof to permit positioning of the heads 46 of the reinforcing bars therein and then sliding of the heads into the slots 47.

FIG. 4 exemplifies the versatility of the invention in joining a horizontal slab 55 to a vertical wall 56.

During the forming operation for the wall 56, a coupling member 10 is positioned with its fin 15 at the edge 57 of a form defined keyway in wall 56. A plurality of rebars 58 with the joining member 18 thereon ae positioned on flange 12 of coupling member 10. When the wall 56 has been poured and cured, and the forms stripped therefrom, a portion of the coupling member 10 with flange 11 thereon will extend from edge 57 into the confines of the defined keyway. Thereafter, when the forms for slab 55 are constructed the reinforcing bars 59 with joining members 18 thereon are joined to flange 11 as previously described.

This construction provides a maximum development of tensile strength of the reiforcing bars with a minimum of forming. The entire coupling member is within the keyway and the wall forms (not shown). This enables the contractor full use of metal forms without expenditure of time in laying out and drilling holes in a form portion defining the wall edge 57 for extension of reinforcing bars therethrough.

These last two described constructions permit the present forming of columns and walls for future expansion. The flanged edges of the coupling members reside entirely within the confines of the keyways and present no impediments or extensions from the outside surfaces of the wall.

Figure 5:
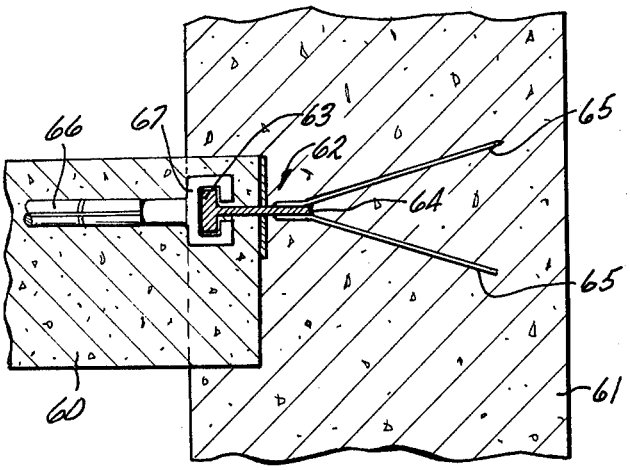
FIG. 5 is a view similar to FIG. 4 showing an alternate construction for tying a concrete slab to a concrete wall.
Figure 6:
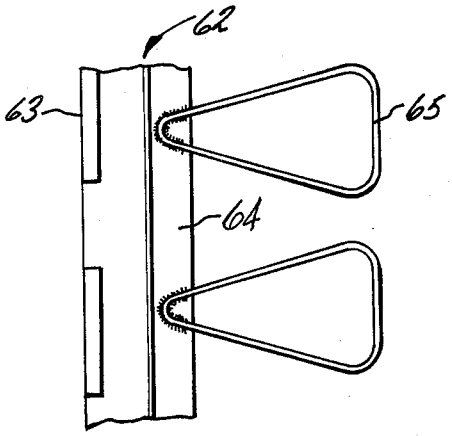
FIG. 6 is a plan view of the coupling member of FIG. 5.

FIG. 5 shows another technique utilizing the invention of joining a horizontal slab 60 to a vertical wall 61 having a key defined therein to receive the end of slab 60. A joining member 62 is provided at one end thereof with an interrupted flange 63 as previously described. At the other end 64 of the joining member there are welded a plurality of wire loops 65, as more clearly shown in FIG. 6 which are designed to be embedded in wall 61. After the wall 61 has been poured and cured the forms defining the key are removed. Then the forms for slab 60 are erected, the reinforcing bars 66 with joining members 67 thereon positioned along the length.

Figure 7:
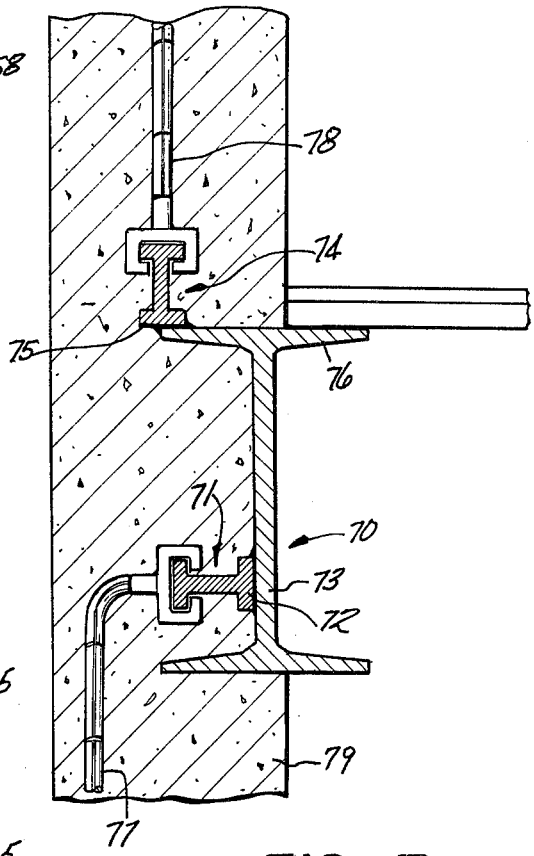
FIG. 7 is a view in elevation of a section of concrete wall which is braced to a steel beam utilizing the invention.

FIG. 7 exemplifies how the invention may be utilized in bracing and tying concrete or masonary walls to previously erected steel work. The structure includes a horizontal I-beam 70 supported by vertical columns (not shown). A coupling member 71 is positioned as by welding flange 72 thereof to the web 73 of beam 70. Also a coupling member 74 has one flange 75 thereof welded to the upper flange 76 of beam 70. Rebars 77 may later be joined to coupling members 71 and rebars 78 joined to coupling members 74 as previously described, the form for wall 79 constructed and the wall poured with the reinforcing bars therein.

The joining technique and members embodying the invention may also be utilized in the hanging of concrete walls from steel beams, to tie reinforcing bars for concrete slabs to steel columns and otherwise connect reinforcing bars to steel girders and structural members which will be later included in a concrete pour. This may easily be accomplished merely by welding the coupling member to the desired position of the steel framework, and then later attaching the reinforcing bars thereto as previously described.

The heads or the joining members are preferably attached to the ends of the rebars by a technique known as stud welding. In the stud welding process, the end of the shanks of the joining members are positioned in close proximity of the end of the reinforcing bar. Electrical contact is made adjacent the end of the rebar and also on the joining member. A welding arc is initiated and puddles the adjacent ends. When the puddling occurs, the adjacent ends of the shank and the rebar become molten and the molten end of the shank is then merged into the molten area of the rebar and complete integral bonding of the metal of the rebars to the joining members occurs.

Figure 8:
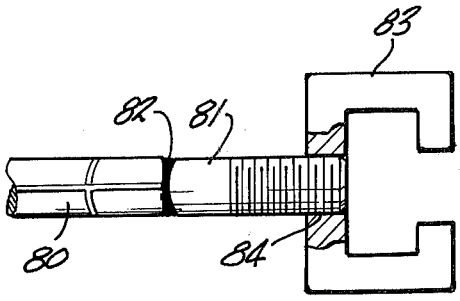
FIG. 8 is a drawing showing the manner in which a retaining member may be coupled to a concrete reinforcing bar.

FIG. 8 exemplifies another form of a joining member which may be utilized with a rebar 80. A threaded stud 81 is welded to the end of the rebar as exemplified at 82 and then head portion 83 of a joining member is matingly threaded as indicated at 84 on the threaded shank 81.

From the foregoing it may be seen that the invention provides a new and improved technique of coupling reinforcing bars at concrete construction joints, and which substantially decreases the present forming problems. Moreover, the apparatus of the present invention provides full development of tensile strength between reinforcing bars at concrete construction joints. Further, the invention allows later additions to existing concrete structures for future expansion.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A method of connecting a first concrete section to a later poured section on site comprising the steps of providing a form for the first section with a dam at an edge of the first section and providing an elongated rigid coupling member extending along the length of said dam and having integral side edges extending laterally therefrom through said dam and essentially parallel to said member, providing reinforcing bars having coupling means on the ends thereof, said coupling means and said side edges having cooperating interlocking means permitting said coupling means to be joined to said side edges and moved longitudinally for positioning thereon but preventing withdrawal of said coupling means from said side edge, mechanically interlocking said coupling means of said reinforcing bars to said coupling member along the side edge thereof within the formed section with the reinforcing bars extending substantially perpendicular to said elongated member, and positioning said bars along the length of said coupling member, pouring the first section, removing the dam, mechanically interlocking reinforcing bars to said coupling member along the other side edge thereof and positioning said bars along the length of said coupling member, and pouring the second section.

2. A method of connecting a first concrete section to a later poured section on site comprising the steps of providing an elongated rigid coupling member having an integral elongated side edge essentially parallel to said member with first coupling means defined thereon, pouring the first section with said coupling member therein and said side edge extending therefrom, providing reinforcing bars having second coupling means on the ends thereof, said first and second coupling means having cooperating interlocking means permitting said second coupling means to be joined to said first coupling means and moved longitudinally for positioning thereon but preventing withdrawal of said reinforcing bars from said first coupling means, mechanically interlocking said second coupling means to said first coupling means and positioning said reinforcing bars along the length of said first coupling member with said reinforcing bars extending substantially perpendicular thereto, and pouring said second section with said reinforcing bars therein.

3. The method of claim 2 wherein said coupling member has a second side edge with anchoring means thereon for embedding in said first section.

4. The method of claim 2 wherein the coupling means on the ends of said reinforcing bars are joined to said bars by passing a welding current therebetween axially of the bars.

5. The method of claim 2 wherein a damming member extends along the length of said elongated member.

* * * * *

UNITED STATES PATENT AND TRADEMARK OFFICE

CERTIFICATE OF CORRECTION

PATENT NO. : 4,020,132
DATED : April 26, 1977
INVENTOR(S) : Anthony J. Calini

It is certified that error appears in the above-identified patent and that said Letters Patent are hereby corrected as shown below:

Column 1, delete lines 5 and 6.

Column 2, line 15, "therefore" should read --therefor--.

Column 2, line 38, "numberal" should read --numeral--.

Column 2, line 43, "in" should read --an--.

Column 3, line 29, "ae" should read --are--.

Column 4, line 16, "ae" should read --are--.

Column 4, line 26, "reiforcing" should read --reinforcing--.

Column 4, line 57, insert "one" after "welding".

Column 5, line 16, after "and" insert --a--.

Column 5, line 23, after "on" insert --to--.

Signed and Sealed this

*second* Day of *August 1977*

[SEAL]

*Attest:*

RUTH C. MASON
*Attesting Officer*

C. MARSHALL DANN
*Commissioner of Patents and Trademarks*